US008286827B2

(12) United States Patent
Yacktman

(10) Patent No.: US 8,286,827 B2
(45) Date of Patent: Oct. 16, 2012

(54) SIPPY CUP LID FOR A BEVERAGE CAN

(75) Inventor: Ellyn Audrey Yacktman, Austin, TX (US)

(73) Assignee: Wee Sip, LLC, Austin, TX (US)

( * ) Notice: Subject to any disclaimer, the term of this patent is extended or adjusted under 35 U.S.C. 154(b) by 236 days.

(21) Appl. No.: 12/772,703

(22) Filed: May 3, 2010

(65) Prior Publication Data

US 2011/0266295 A1 Nov. 3, 2011

(51) Int. Cl.
*B65D 41/18* (2006.01)
*B65D 41/16* (2006.01)

(52) U.S. Cl. ..... 220/789; 220/780

(58) Field of Classification Search ..... 220/789, 220/790, 791, 793, 780, 254.1, 713, 711, 220/703, 906, 716, 717; 215/317, 316, 200; *B65D 41/18, 41/16, 39/00*
See application file for complete search history.

(56) References Cited

U.S. PATENT DOCUMENTS

| | | | | | |
|---|---|---|---|---|---|
| 4,312,459 | A | | 1/1982 | Leach | |
| 4,403,709 | A | * | 9/1983 | Meins et al. | 220/703 |
| 4,579,257 | A | * | 4/1986 | Brandlein | 222/192 |
| 4,679,702 | A | * | 7/1987 | Maccarone et al. | 220/717 |
| 4,767,019 | A | * | 8/1988 | Horner | 220/713 |
| 4,852,776 | A | * | 8/1989 | Patton | 222/570 |
| 4,917,258 | A | | 4/1990 | Boyd et al. | |
| 4,961,510 | A | * | 10/1990 | Dvoracek | 220/713 |
| 5,165,579 | A | * | 11/1992 | Lund | 222/192 |
| 5,363,983 | A | * | 11/1994 | Proshan | 220/717 |
| 5,692,633 | A | * | 12/1997 | Gordon | 220/253 |
| 6,098,830 | A | | 8/2000 | Jamieson | |
| 6,164,484 | A | | 12/2000 | Fiore et al. | |
| 6,290,084 | B1 | * | 9/2001 | Louie | 220/254.4 |
| 6,502,418 | B2 | | 1/2003 | Holley, Jr. | |
| D527,254 | S | | 8/2006 | Antonelli | |
| 7,185,784 | B2 | | 3/2007 | Connors, Jr. et al. | |
| 7,222,746 | B2 | | 5/2007 | Eckstrum | |
| D558,825 | S | | 1/2008 | Masters | |
| D559,622 | S | | 1/2008 | Carreno | |
| D564,356 | S | | 3/2008 | Nickleberry | |
| 7,387,202 | B2 | | 6/2008 | Beaty | |
| D578,392 | S | * | 10/2008 | Khalil | D9/454 |
| D579,721 | S | | 11/2008 | Qian | |
| D579,722 | S | | 11/2008 | Sakulsacha et al. | |
| 7,513,465 | B2 | | 4/2009 | Prado | |
| 7,556,172 | B2 | | 7/2009 | Lane | |
| 7,591,273 | B2 | | 9/2009 | Holley, Jr. | |
| D609,046 | S | | 2/2010 | Valderrama et al. | |
| 2004/0000551 | A1 | * | 1/2004 | Flink et al. | 220/258.3 |
| 2008/0035653 | A1 | | 2/2008 | Meli | |
| 2008/0264960 | A1 | | 10/2008 | Phillips et al. | |

* cited by examiner

*Primary Examiner* — Mickey Yu
*Assistant Examiner* — Robert J Hicks

(57) ABSTRACT

A removable sippy cup lid configured to be placed securely onto an opened beverage can. The removable sippy cup lid includes a drinking spout shaped to correspond to the cavity opening in the beverage can lid. Furthermore, the sippy cup lid includes a groove about its edge sized to receive and snap over a circular outer rim of the beverage can lid to form a seal. The groove includes an arc shaped channel cross section that bends inward leaving an opening at a distal end, where the opening covers the beverage can rim. A width of the opening is less than a thickness of the beverage can rim in a resting position. The groove is made out of flexible material such that the width of the opening widens to the thickness of the beverage can rim as pressure is applied to the sippy cup lid to snap over the rim.

20 Claims, 3 Drawing Sheets

SIPPY CUP LID FOR A BEVERAGE CAN

TECHNICAL FIELD

The present invention relates to liquid containers, and more particularly to a sippy cup lid for a beverage can, such as an aluminum soda can.

BACKGROUND OF THE INVENTION

There are a variety of liquid containers, such as beverage cans. A beverage can is a container manufactured from aluminum or steel (e.g., tin-plated steel) designed to hold a single serving of a beverage. For example, a common beverage can is a soda can used for holding soda. Typically, soda cans have a stay-tab opening mechanism. This mechanism involves utilizing a scored lid with a tab to depress the lid. The tab can be used as a lever to push the scored region into the can, opening up a hole. However, there is no mechanism to prevent spillage from drinking from such a can. That is, a user, such as a child, may spill a portion of the beverage from such a can that is opened up using a stay-tab opening mechanism.

A sippy cup is a training cup that lets a child drink without spilling. Sippy cups typically include a lid with a spout that lets a child drink without spilling. While sippy cups are typically used to help transition babies from bottles to regular cups, it is a mechanism to prevent spillage.

If a beverage can, such as a soda can, could have a sippy cup lid placed on the beverage can after opening it, then a user, such as a child, may be able to drink from such a beverage without spillage.

Therefore, there is a need in the art for developing a sippy cup lid to prevent spillage from an opened beverage can, such as a soda can.

BRIEF SUMMARY OF THE INVENTION

In one embodiment of the present invention, a removable sippy cup lid comprises a drinking spout, where the drinking spout extends upward from a surface of the sippy cup lid to a distal end shaped and sized to be received within a human mouth. A proximal end of the drinking spout is shaped to correspond to a shape of a cavity opening in a lid of a beverage can with a stay-tab opening mechanism, where the cavity opening is formed in a scored region of the lid of the beverage can caused by using a stay-tab as a lever to push the scored region into the lid of the beverage can. Furthermore, the removable sippy cup lid comprises a groove about its edge sized to receive and snap over a circular outer rim of the lid of the beverage can to faun a seal, where the groove comprises an inner and outer portion forming an arc shaped channel cross section that bends inward leaving an opening at a distal end, where the opening covers the rim of the lid of the beverage can. A width of the opening is less than a thickness of the rim of the lid of the beverage can in a resting position. The groove is made out of flexible material, where the width of the opening widens to the thickness of the rim of the lid of the beverage can as pressure is applied to the sippy cup lid to snap over the rim of the lid of the beverage can.

In another embodiment of the present invention, a drinking container, comprises a beverage can with a stay-tab opening mechanism, where the beverage can comprises a main body defining an interior cavity accessible through a cavity opening. The beverage can further comprises a lid coupled to the main body, where the lid comprises a circular outer rim. The circular outer rim is outwardly projecting, where the circular outer rim adjoins the main body at a top portion of the main body that is slanted downwardly and outwardly. The lid comprises the cavity opening in a scored region of the lid caused by using a stay-tab as a lever to push the scored region into the lid of the beverage can. The drinking container further comprises a removable sippy cup lid secured to the beverage can to cover the lid of the beverage can, where the sippy cup lid comprises a drinking spout. The drinking spout extends upward from a surface of the sippy cup lid to a distal end shaped and sized to be received within a human mouth. A proximal end of the drinking spout is shaped to correspond to a shape of the cavity opening. The removable sippy cup lid further comprises a groove about its edge sized to receive and snap over the rim of the lid of the beverage can to form a seal, where the groove comprises an inner and outer portion forming an arc shaped channel cross section that bends inward leaving an opening at a distal end. The opening covers the circular outer rim of the lid of the beverage can, where a width of the opening is less than a thickness of the rim of the lid of the beverage can in a resting position. The groove is made out of flexible material, where the width of the opening widens to the thickness of the rim of the lid of the beverage can as pressure is applied to the sippy cup lid to snap over the rim of the lid of the beverage can.

The foregoing has outlined rather generally the features and technical advantages of one or more embodiments of the present invention in order that the detailed description of the present invention that follows may be better understood. Additional features and advantages of the present invention will be described hereinafter which may form the subject of the claims of the present invention.

BRIEF DESCRIPTION OF THE SEVERAL VIEWS OF THE DRAWING

A better understanding of the present invention can be obtained when the following detailed description is considered in conjunction with the following drawings, in which.

DETAILED DESCRIPTION OF THE INVENTION

The present invention comprises a drinking container and a sippy cup lid. In one embodiment of the present invention, a removable sippy cup lid configured to be placed securely onto an opened beverage can (e.g., aluminum soda can) includes a drinking spout. The drinking spout extends upward from a surface of the sippy cup lid to a distal end shaped and sized to be received within a human mouth. A proximal end of the drinking spout is shaped to correspond to the shape of the cavity opening in the beverage can lid with a stay-tab opening mechanism. The cavity opening is formed in a scored region of the beverage can lid caused by using a stay-tab as a lever to push the scored region into the lid of the beverage can. Furthermore, the removable sippy cup lid includes a groove about its edge sized to receive and snap over a circular outer rim of the beverage can lid to form a seal. The groove includes an inner and outer portion forming an arc shaped channel cross section that bends inward leaving an opening at a distal end, where the opening covers the rim of the beverage can lid. A width of the opening is less than a thickness of the rim of the beverage can lid in a resting position. The groove is made out of flexible material such that the width of the opening widens to the thickness of the rim of the beverage can lid as pressure is applied to the sippy cup lid to snap over the rim of the beverage can lid. In this manner, a sippy cup lid is developed to prevent spillage from an opened beverage can, such as a soda can.

As stated in the Background section, if a beverage can, such as a soda can, could have a sippy cup lid placed on the beverage can after opening it, then a user, such as a child, may be able to drink from such a beverage without spillage. Therefore, there is a need in the art for developing a sippy cup lid to prevent spillage from an opened beverage can, such as a soda can.

Figure 1:
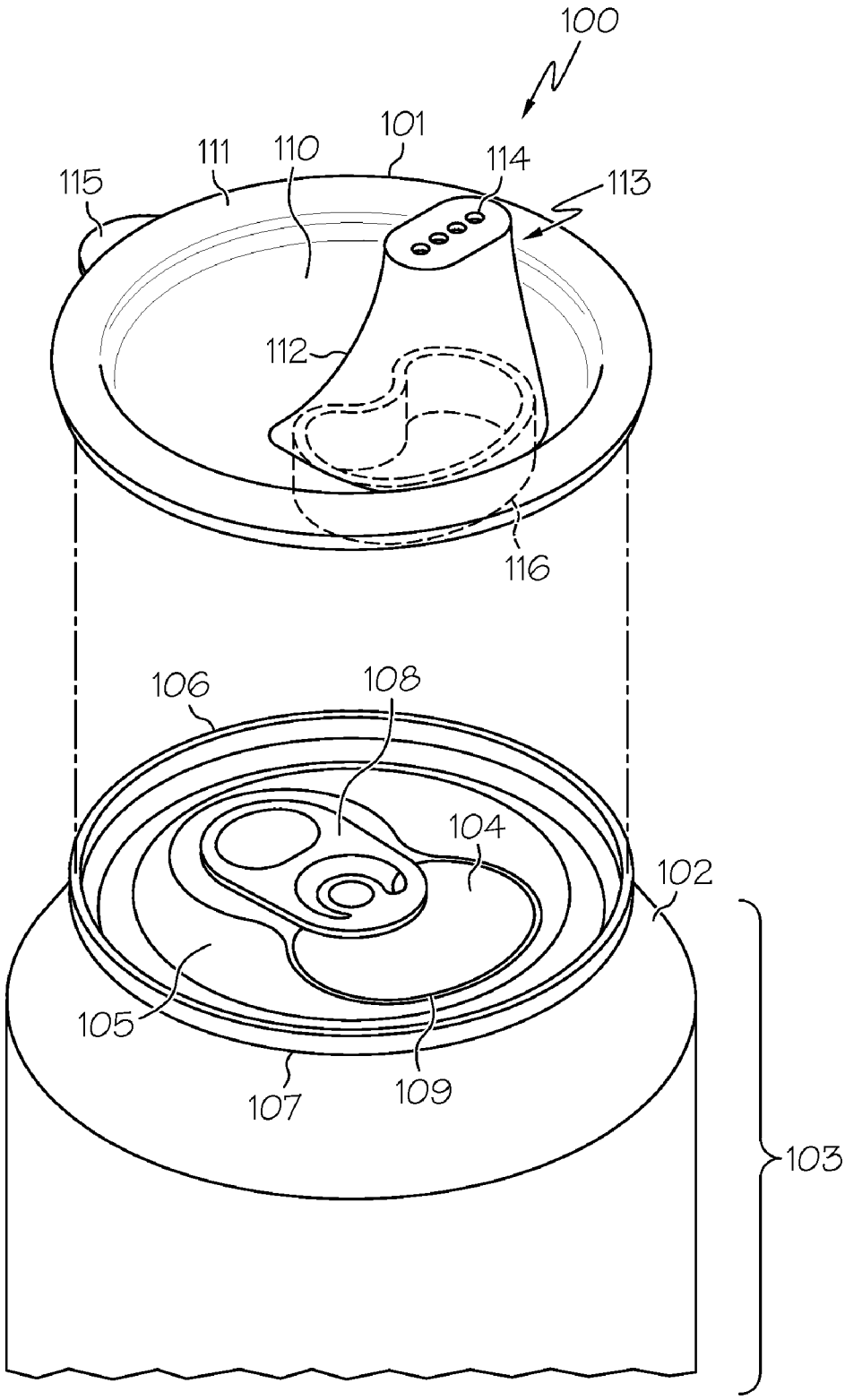
FIG. 1 illustrates a drinking container that includes a sippy cup lid to be snapped securely onto an opened beverage can in accordance with an embodiment of the present invention.
Figure 2:
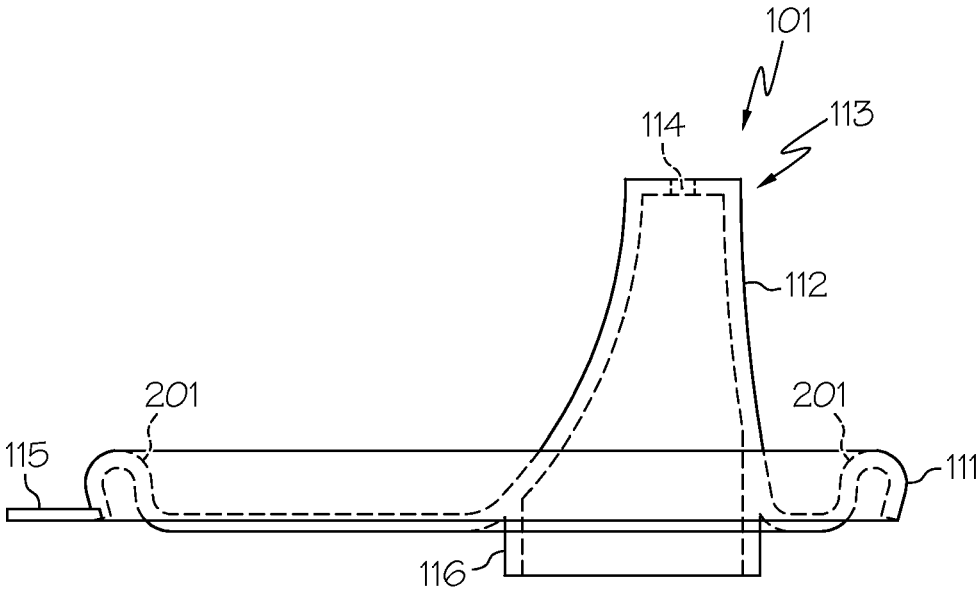
FIG. 2 is a side view of the sippy cup lid illustrating the groove located on the underside of the sippy cup lid to receive the rim of the beverage can as well as a lip that extends from the proximal end of the spout into an inner portion of the beverage can in accordance with an embodiment of the present invention.
Figure 3:
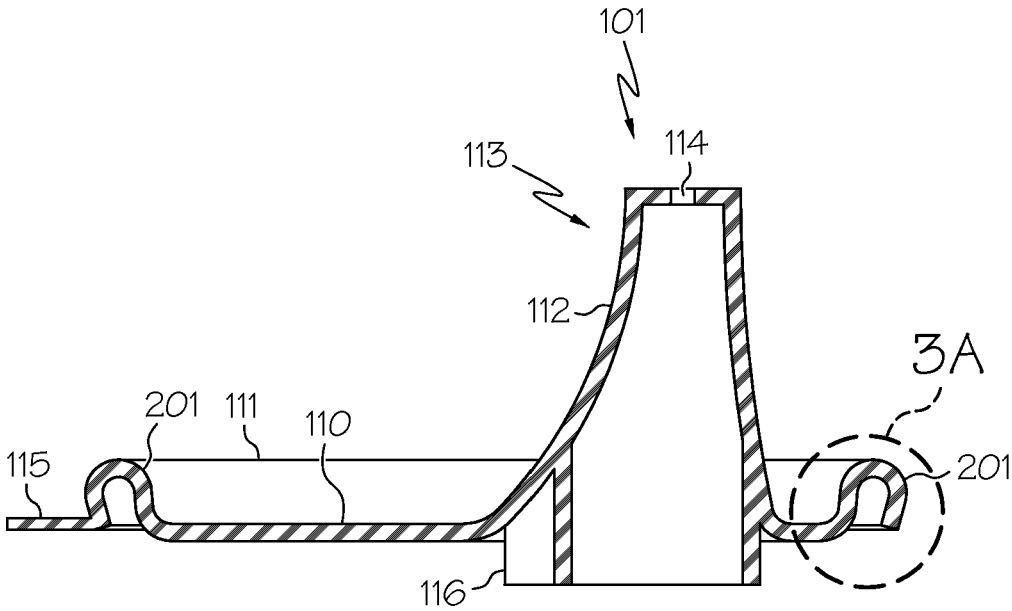
FIG. 3 is a cross sectional view of the sippy cup lid as referenced in FIG. 4 illustrating more succinctly the components that are not visible on the outside of the sippy cup lid in accordance with an embodiment of the present invention.
Figure 3A:
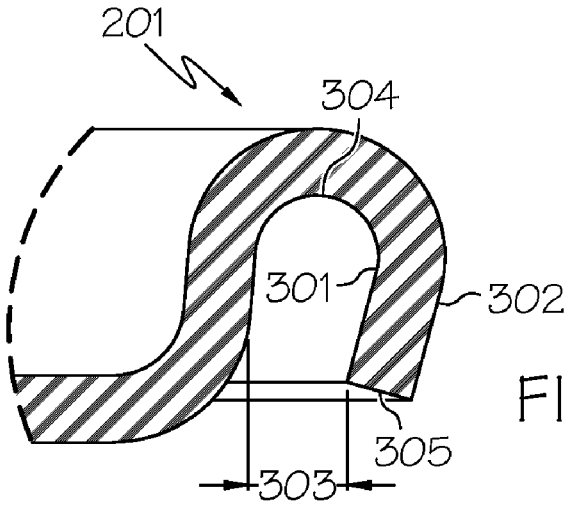
FIG. 3A is an up-close illustration of the groove in accordance with an embodiment of the present invention.
Figure 4:
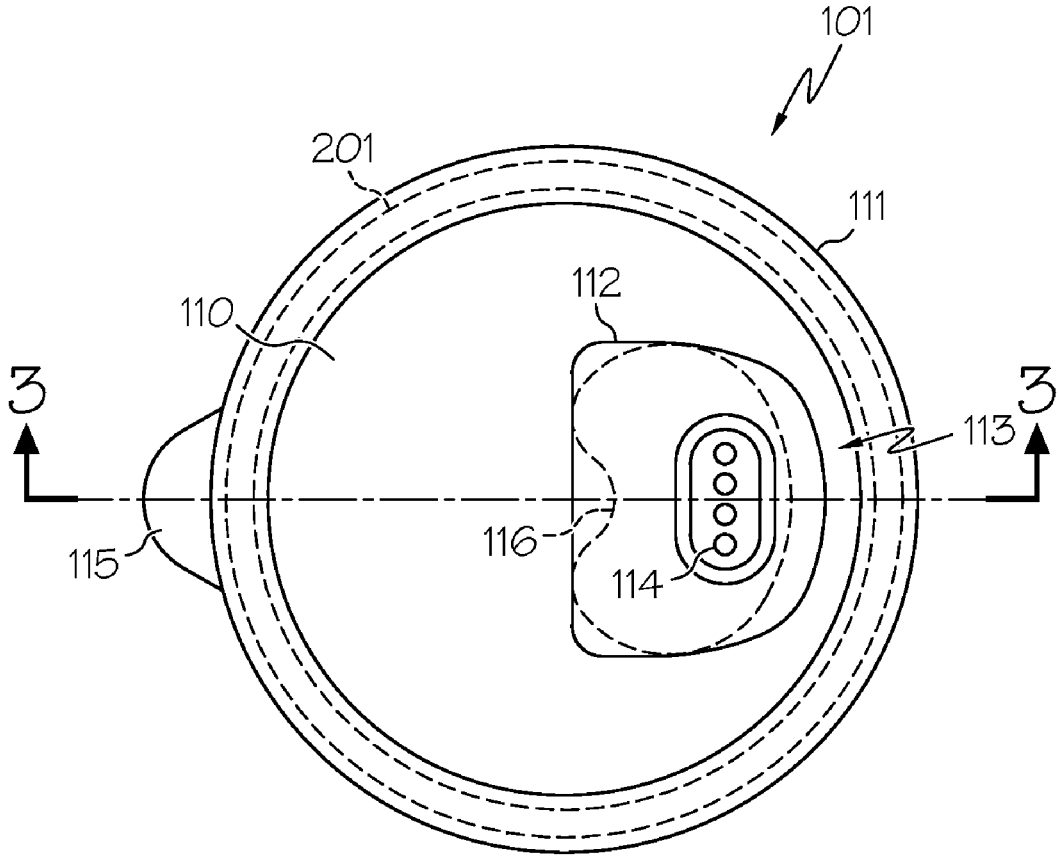
FIG. 4 is a top view of the sippy cup lid in accordance with an embodiment of the present invention.

The sippy cup lid of the present invention is configured to be placed securely onto the beverage can (e.g., an aluminum soda can) after opening it where the beverage is prevented from spillage as discussed below in connection with FIGS. 1-3, 3A and 4. FIG. 1 illustrates a sippy cup lid being snapped securely onto an opened beverage can. FIG. 2 is a side view of the sippy cup lid illustrating the groove located on the underside of the sippy cup lid to receive the rim of the beverage can as well as a lip that extends from the proximal end of the spout into an inner portion of the beverage can. FIG. 3 is a cross sectional view of the sippy cup lid as referenced in FIG. 4 illustrating more succinctly the components that are not visible on the outside of the sippy cup lid. FIG. 3A is an up-close illustration of the groove. FIG. 4 is top view of the sippy cup lid.

Referring to FIG. 1, FIG. 1 illustrates a drinking container 100 that includes a sippy cup lid 101 to be snapped securely onto a beverage can 102 in accordance with an embodiment of the present invention.

Turning now to FIG. 1, beverage can 102 includes a main body 103 that defines an interior cavity accessible through a cavity opening 104. Beverage can 102 further includes a lid 105 connected to main body 103. Lid 105 includes a circular outer rim 106 that adjoins main body 103 at a top portion 107 of main body 103. In one embodiment, outer rim 106 is projected upwardly and outwardly. In one embodiment, outer rim 106 is outwardly projecting at about 0.2 centimeters in length. In one embodiment, outer rim 106 has a thickness of about 0.1 centimeters.

Lid 105 includes a stay-tab mechanism 108 that is used to open beverage can 102. For example, stay-tab 108 is used as a lever to push a scored region 109 into lid 105 thereby causing cavity opening 104 to form.

To prevent spillage from an opened beverage can, such as beverage can 102, sippy cup lid 101 may be placed over opened beverage can 102 forming a seal thereby allowing a user, such as a child, to drink the beverage contained in beverage can 102 without spillage.

As illustrated in FIG. 1, sippy cup lid 101 includes a planar upper surface 110 about the perimeter of which a circular ridge 111 extends upward to form a groove (shown and discussed below in connection with FIG. 2) on the underside of lid 101 to receive rim 106 of beverage can 102. Lid 101 further includes a drinking spout 112, integrally molded with the rest of lid 101, that extends upward from surface 110 to a distal end 113 shaped and sized to be comfortably received in a user's mouth (e.g., child) for drinking. The upper end of spout 112 may include a series of drinking openings or holes 114 used for the transportation of the liquid contained in beverage can 102 into the mouth of the user. The proximal end of spout 112 may have an opening that is shaped corresponding to cavity opening 104. In one embodiment, lid 101 includes one or more openings (not shown) on surface 110 opposite spout 112 for airflow purposes.

Sippy cup lid 101 further includes a tab 115 that extends laterally from an edge of lid 101 opposite spout 112 for prying lid 101 off of beverage can 102.

Additionally, in one embodiment, an inner lip 116 of spout 112 extends from the proximal end of spout 112 into an inner portion of cavity opening 104 thereby preventing spillage into the bottom portion of sippy cup lid 101 when sippy cup lid 101 is secured to beverage can 102. In one embodiment, inner lip 116 is made out of rubber-like material. In one embodiment, the bottom portion of sippy cup lid 101 is substantially planar thereby pressing down stay-tab 108 (stay-tab 108 may be partially raised upon being used to form cavity opening 104) after lid 101 is secured to beverage can 102. In one embodiment, the substantially planar bottom portion of sippy cup lid 101 is aligned with the top portion of rim 106 upon being secured to beverage can 102. In one embodiment, the bottom portion of sippy cup lid 101 has an arc-shaped-like bottom thereby providing a slight elevation over stay-tab 108, which may be partially raised upon being used to form cavity opening 104.

In one embodiment, sippy cup lid 101 is molded out of polypropylene.

Sippy cup lid 101 is able to form an air tight seal at the top of main body 103 of beverage can 102 by including a groove on the underside of lid 101 to receive rim 106 of beverage can 102 as discussed below in connection with FIG. 2.

FIG. 2 is a side view of sippy cup lid 101 (FIG. 1) that includes a groove on the underside of lid 101 (FIG. 1) to receive rim 106 (FIG. 1) of beverage can 102 (FIG. 1) in accordance with an embodiment of the present invention.

Referring to FIG. 2, in conjunction with FIG. 1, sippy cup lid 101 includes a groove 201 about its edge on the underside of lid 101 to receive and snap over rim 106 of beverage can 102 to form a seal. A further description of groove 201 is provided below in connection with FIG. 3A.

As further illustrated in FIG. 2, sippy cup lid 101 includes inner lip 116 of spout 112 that extends from the proximal end of spout 112 into an inner portion of beverage can 102.

FIG. 3 is a cross sectional view of the sippy cup lid 101 as referenced in FIG. 4 illustrating more succinctly the components that are not visible on the outside of sippy cup lid 101 in accordance with an embodiment of the present invention. Since the features of FIG. 3 have already been discussed in connection with FIGS. 1 and 2, no additional description of FIG. 3 will be provided for the sake of brevity.

A further detail illustration of groove 201 is discussed below in connection with FIG. 3A.

Referring to FIG. 3A, FIG. 3A illustrates a close-up view of groove 201 in accordance with an embodiment of the present invention. Referring to FIG. 3A, in conjunction with FIGS. 1-3, groove 201 is formed by an inner and outer portion 301, 302, respectively, forming an arc shaped or horseshoe-like shaped channel cross section that bends inward (as illustrated in FIG. 3A) leaving an opening 303 at the distal end of groove 201. Opening 303 is used to cover the circular outer rim 106 of lid 105 of beverage can 102. The width of opening 303 is less than the thickness of rim 106 in what is referred to herein as the "resting position." Resting position refers to when sippy cup lid 101 is not currently positioned on beverage can 102. In one embodiment, the width of opening 303 at the resting position is less than 0.1 centimeters.

When a user applies pressure to push sippy cup lid 101 onto lid 105 of beverage can 102, opening 303 widens to the thickness of rim 106 of lid 105 of beverage can 102 thereby allowing sippy cup lid 101 to snap over rim 106 forming a seal. Since groove 201 is made out of a flexible material, opening 303 may widen to the thickness of rim 106 (e.g., 0.2 centimeters). In one embodiment, the flexible material is molded plastic. Furthermore, groove 201 is not so flexible that it loses its tenseness. Hence, when opening 303 of groove 201 is expanded in width, groove 201 maintains its tenseness thereby providing a secure seal.

In one embodiment, the length of inner portion 301 from the top of its arc 304 to the end of its arc 305 in a vertical direction corresponds to a length of rim 106 in its vertical direction. In one embodiment, the length of inner portion 301 from the top of its arc 304 to the end of its arc 305 in a vertical direction is about 0.2 centimeters.

As illustrated in FIG. 3A, in one embodiment, inner/outer portions 301, 302 of groove are projected downwardly and inwardly in opposite of the projection of rim 106 of beverage can 102.

A top view of sippy cup lid 101 is discussed below in connection with FIG. 4. FIG. 4 is a top view of sippy cup lid 101 (FIG. 1) that includes a groove 201 (FIGS. 2, 3 and 3A) on the underside of lid 101 to receive rim 106 of beverage can 102 (FIG. 1) in accordance with an embodiment of the present invention.

Referring to FIG. 4, in conjunction with FIGS. 1-3 and 3A, sippy cup lid 101 includes groove 201 about its edge on the underside of lid 101 to receive and snap over rim 106 of beverage can 102 to form a seal. As discussed above, groove 201 may take the shape of an arc or horseshoe-like channel cross section that bends inward. As further illustrated in FIG. 4, sippy cup lid 101 includes inner lip 116 of spout 112 that extends from the proximal end of spout 112 into an inner portion of beverage can 102.

Although the removable sippy cup lid and drinking container are described in connection with several embodiments, it is not intended to be limited to the specific forms set forth herein, but on the contrary, it is intended to cover such alternatives, modifications and equivalents, as can be reasonably included within the spirit and scope of the invention as defined by the appended claims.

The invention claimed is:

1. A removable sippy cup lid, comprising:

a drinking spout, wherein said drinking spout extends upward from a surface of said sippy cup lid to a distal end shaped and sized to be received within a human mouth, wherein a proximal end of said drinking spout is shaped to correspond to a shape of a cavity opening in a lid of a beverage can with a stay-tab opening mechanism, wherein said cavity opening is formed in a scored region of said lid of said beverage can caused by using a stay-tab as a lever to push said scored region into said lid of said beverage can; and a groove about an edge of said sippy cup lid sized to receive and snap over a circular outer rim of said lid of said beverage can to form a seal, wherein said groove comprises an inner and outer portion forming an arc shaped channel cross section that bends inward leaving an opening at a distal end, wherein said opening covers said rim of said lid of said beverage can, wherein a width of said opening is less than a thickness of said rim of said lid of said beverage can in a resting position, wherein said groove is made out of flexible material, wherein said width of said opening widens to said thickness of said rim of said lid of said beverage can as pressure is applied to said sippy cup lid to snap over said rim of said lid of said beverage can.

2. The removable sippy cup lid as recited in claim 1, wherein said beverage can is a soda can.

3. The removable sippy cup lid as recited in claim 1, wherein said beverage can is an aluminum can.

4. The removable sippy cup lid as recited in claim 1, wherein said circular outer rim is outwardly projecting at about 0.2 centimeters in length.

5. The removable sippy cup lid as recited in claim 1, wherein said groove is downwardly projecting at about 0.2 centimeters in length.

6. The removable sippy cup lid as recited in clam 1, wherein said flexible material is molded plastic.

7. The removable sippy cup lid as recited in claim 1 further comprises:

a bending tab extending radially outward from an edge of said removable sippy cup lid opposite said drinking spout.

8. The removable sippy cup lid as recited in claim 1, wherein said width of said opening at said distal end of said groove is less than about 0.1 centimeters at said resting position.

9. The removable sippy cup lid as recited in claim 1, wherein said thickness of said rim of said lid of said beverage can is about 0.1 centimeters.

10. The removable sippy cup lid as recited in claim 1 further comprises:

an inner lip of said drinking spout that extends from said proximal end of said drinking spout into an inner portion of said cavity opening thereby preventing spillage into a bottom portion of said sippy cup lid when said sippy cup lid is secured to said beverage can.

11. A drinking container, comprising:

a beverage can with a stay-tab opening mechanism, wherein said beverage can comprises:

a main body defining an interior cavity accessible through a cavity opening;

a lid coupled to said main body, wherein said lid comprises a circular outer rim, wherein said circular outer rim is outwardly projecting, wherein said circular outer rim adjoins said main body at a top portion of said main body that is slanted downwardly and outwardly, wherein said lid comprises said cavity opening in a scored region of said lid caused by using a stay-tab as a lever to push said scored region into said lid of said beverage can; and a removable sippy cup lid secured to said beverage can to cover said lid of said beverage can, wherein said sippy cup lid comprises:

a drinking spout, wherein said drinking spout extends upward from a surface of said sippy cup lid to a distal end shaped and sized to be received within a human mouth, wherein a proximal end of said drinking spout is shaped to correspond to a shape of said cavity opening; and a groove about an edge of said sippy cup lid sized to receive and snap over said rim of said lid of said beverage can to form a seal, wherein said groove comprises an inner and outer portion forming an arc shaped channel cross section that bends inward leaving an opening at a distal end, wherein said opening covers said circular outer rim of said lid of said beverage can, wherein a width of said opening is less than a thickness of said rim of said lid of said beverage can in a resting position, wherein said groove is made out of flexible material, wherein said width of said opening widens to said thickness of said rim of said lid of said beverage can as pressure is applied to said sippy cup lid to snap over said rim of said lid of said beverage can.

12. The drinking container as recited in claim 11, wherein said beverage can is a soda can.

13. The drinking container as recited in claim 11, wherein said beverage can is an aluminum can.

14. The drinking container as recited in claim 11, wherein said circular outer rim is outwardly projecting at about 0.2 centimeters in length.

15. The drinking container as recited in claim 11, wherein said groove is downwardly projecting at about 0.2 centimeters in length.

16. The drinking container as recited in clam 11, wherein said flexible material is molded plastic.

17. The drinking container as recited in claim 11, wherein said sippy cup lid further comprises:

a bending tab extending radially outward from an edge of said removable sippy cup lid opposite said drinking spout.

18. The drinking container as recited in claim 11, wherein said width of said opening at said distal end of said groove is less than about 0.1 centimeters at said resting position.

19. The drinking container as recited in claim 11, wherein said thickness of said rim of said lid of said beverage can is about 0.1 centimeters.

20. The drinking container as recited in claim 11, wherein said sippy cup lid further comprises:

an inner lip of said drinking spout that extends from said proximal end of said drinking spout into an inner portion of said cavity opening thereby preventing spillage into a bottom portion of said sippy cup lid when said sippy cup lid is secured to said beverage can.

* * * * *